US011460190B2

(12) United States Patent
Cadima

(10) Patent No.: US 11,460,190 B2
(45) Date of Patent: Oct. 4, 2022

(54) GAS BURNER ASSEMBLY FOR A COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 204 days.

(21) Appl. No.: 16/524,556

(22) Filed: Jul. 29, 2019

(65) Prior Publication Data

US 2021/0033279 A1 Feb. 4, 2021

(51) Int. Cl.

| | |
|---|---|
| ***F23D 14/06*** | (2006.01) |
| ***F23D 14/84*** | (2006.01) |
| ***F24C 3/10*** | (2006.01) |
| ***F24C 3/08*** | (2006.01) |

(52) U.S. Cl.

CPC ..... *F23D 14/06* (2013.01); *F23D 14/84* (2013.01); *F24C 3/082* (2013.01); *F24C 3/10* (2013.01)

(58) Field of Classification Search

CPC ..... F23D 14/02; F23D 14/06; F23D 14/082; F23D 14/46; F23D 14/60; F23D 14/84; F23D 2203/1017; F23C 3/10; F23C 5/02; F23C 5/10; F24C 3/082; F24C 3/085; F24C 3/10; B23P 15/00; F16B 21/065; F16B 21/071; F16M 11/04

USPC ..... 126/39 E; 431/284, 264, 266

See application file for complete search history.

(56) References Cited

U.S. PATENT DOCUMENTS

| | | | | |
|---|---|---|---|---|
| 1,716,601 A * | 6/1929 | Reznor | F23D 14/105 29/890.02 |
| 1,923,393 A * | 8/1933 | Pickup | F23D 14/06 239/543 |
| 2,041,348 A * | 5/1936 | Johnson | F23D 14/26 431/349 |
| 4,311,451 A | 1/1982 | Matumoto et al. | |
| 5,490,778 A * | 2/1996 | Meijer | F23D 14/06 239/554 |

(Continued)

FOREIGN PATENT DOCUMENTS

| | | | |
|---|---|---|---|
| CN | 101509672 A * | 8/2009 | F23D 14/06 |
| CN | 1594975 B | 4/2010 | |

(Continued)

OTHER PUBLICATIONS

Machine Translation of Miao (CN 101509672 A) (Year: 2009).*
Machine Translation of Acosta Herrero et al (EP 3255341 A1) (Year: 2017).*

*Primary Examiner* — Jorge A Pereiro
*Assistant Examiner* — Nikhil P Mashruwala
(74) *Attorney, Agent, or Firm* — Dority & Manning, P.A.

(57) ABSTRACT

A gas burner assembly for a cooktop appliance includes a flame ring comprising a plurality of flame ports arranged in an annular array. An outer ring and an inner ring collectively define each flame port of the plurality of flame ports. The outer ring and the inner ring are concentrically aligned and concentrically mated. As a result of this arrangement of the outer ring and the inner ring, the plurality of flame ports are defined by the outer ring and the inner ring. The plurality of flame ports extend radially between the inner ring and the outer ring.

18 Claims, 11 Drawing Sheets

(56) References Cited

U.S. PATENT DOCUMENTS

| | | | | |
|---|---|---|---|---|
| 5,649,822 | A * | 7/1997 | Gertler | F23D 14/06 126/39 E |
| 5,690,483 | A | 11/1997 | Oda et al. | |
| 5,915,956 | A | 6/1999 | Kwiatek et al. | |
| 6,322,354 | B1 | 11/2001 | Carbone et al. | |
| 6,607,378 | B2 * | 8/2003 | Harneit | F23D 14/06 126/39 E |
| 8,381,714 | B2 * | 2/2013 | Shaffer | F23D 14/62 126/39 E |
| 8,479,721 | B2 | 7/2013 | Graham et al. | |
| 8,845,326 | B2 * | 9/2014 | Shaffer | F23D 14/06 431/284 |
| 8,899,972 | B2 * | 12/2014 | Fowler | F23D 14/06 431/285 |
| 9,612,018 | B2 * | 4/2017 | Bettinzoli | F24C 3/08 |
| 10,274,202 | B2 * | 4/2019 | Cadima | F24C 3/022 |
| 10,415,823 | B2 * | 9/2019 | Acosta Herrero | F23D 14/065 |
| 10,436,451 | B2 * | 10/2019 | Aguilar | F23D 14/583 |
| 10,451,289 | B2 * | 10/2019 | Paller | F23D 14/62 |
| 10,677,469 | B2 * | 6/2020 | Paller | F24C 3/082 |
| 10,823,402 | B2 * | 11/2020 | Cadima | F23D 14/70 |
| 10,830,451 | B2 * | 11/2020 | Cadima | F23L 5/02 |
| 2004/0048216 | A1 | 3/2004 | Brown et al. | |
| 2007/0218414 | A1 * | 9/2007 | Harneit | F23D 14/06 431/354 |
| 2013/0059256 | A1 | 3/2013 | Cadeau | |
| 2014/0048293 | A1 | 2/2014 | Luongo et al. | |
| 2014/0295357 | A1 | 10/2014 | McAfee et al. | |
| 2017/0108226 | A1 * | 4/2017 | Moon | F24C 3/022 |
| 2020/0191387 | A1 * | 6/2020 | Noeth | F23L 1/00 |

FOREIGN PATENT DOCUMENTS

| | | | | |
|---|---|---|---|---|
| CN | 101825281 | B | 8/2012 | |
| CN | 204438127 | U | 7/2015 | |
| CN | 102444892 | B | 1/2016 | |
| CN | 103900103 | B | 1/2016 | |
| EP | 887590 | A1 | 12/1998 | |
| EP | 2534421 | B1 | 3/2014 | |
| EP | 3165828 | A1 | 5/2017 | |
| EP | 3255341 | A1 * | 12/2017 | F23D 14/06 |
| JP | 2002174410 | A | 6/2002 | |
| JP | 3737184 | B2 | 1/2006 | |
| JP | 2007057226 | A | 3/2007 | |
| JP | 04595599 | B2 | 12/2010 | |
| KR | 101885690 | B1 | 8/2018 | |

* cited by examiner

GAS BURNER ASSEMBLY FOR A COOKTOP APPLIANCE

FIELD OF THE INVENTION

The present subject matter relates generally to cooktop appliances and more particularly to gas burner assemblies for cooktop appliances.

BACKGROUND OF THE INVENTION

Gas burners are commonly used on the cooktops of household gas cooking appliances including e.g., range ovens and cooktops built into cabinetry. For example, gas cooktops traditionally have at least one gas burner positioned at a cooktop surface for use in heating or cooking an object, such as a cooking utensil and its contents. Control knobs are typically used to adjust the power level of the heating element, e.g., the amount of fuel directed to the burner, and thus the amount of heat delivered by the gas burner.

Normally aspirated gas burners rely on the energy available in the form of pressure from the fuel supplied to the gas burner to entrain air for combustion. Because the nominal pressure in households is relatively low, there is a practical limit to the amount of primary air a normally aspirated gas burner can entrain. Introducing a fan or another forced air supply into a gas burner assembly may improve the mixture of fuel and air for improved operation at higher outputs, with shorter flames and improved stability, and with improved efficiency. Forced air burners often use tall, narrow, and closely spaced burner ports to minimize the burner footprint and flame lengths, thereby improving heat transfer efficiency.

However, commonly used methods of manufacturing burner heads have limited ability to accommodate such high aspect ratio burner ports. For example, when die casting a burner head, the dies used to produce the burner ports would have very thin walls and would lack the strength and wear properties to withstand the stresses of injecting molten metals. Similarly, forging methods would require dies having long, thin projections too fragile to form the high aspect ratio burner ports.

Accordingly, an improved gas burner assembly is desirable. More particularly, a gas burner assembly including an easily manufactured forced air burner having tall, narrow burner ports would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a gas burner assembly for a cooktop appliance is provided. The gas burner assembly defines an axial direction, a radial direction perpendicular to the axial direction, and a circumferential direction extending around the axial direction. The gas burner assembly includes a plurality of flame ports arranged in an annular array and defining a flame ring of the gas burner assembly. Each flame port of the plurality of flame ports is collectively defined by and between an outer ring and an inner ring. The outer ring and the inner ring are concentrically aligned and concentrically mated so as to define the plurality of flame ports which extend radially between the inner ring and the outer ring.

In another exemplary embodiment, a cooktop appliance is provided. The cooktop appliance includes a top panel and a gas burner assembly positioned on the top panel. The gas burner assembly defines an axial direction, a radial direction perpendicular to the axial direction, and a circumferential direction extending around the axial direction. The gas burner assembly includes a plurality of flame ports which are arranged in an annular array and which define a flame ring of the gas burner assembly. Each flame port of the plurality of flame ports is collectively defined by and between an outer ring and an inner ring. The outer ring and the inner ring are concentrically aligned and concentrically mated so as to define the plurality of flame ports which extend radially between the inner ring and the outer ring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
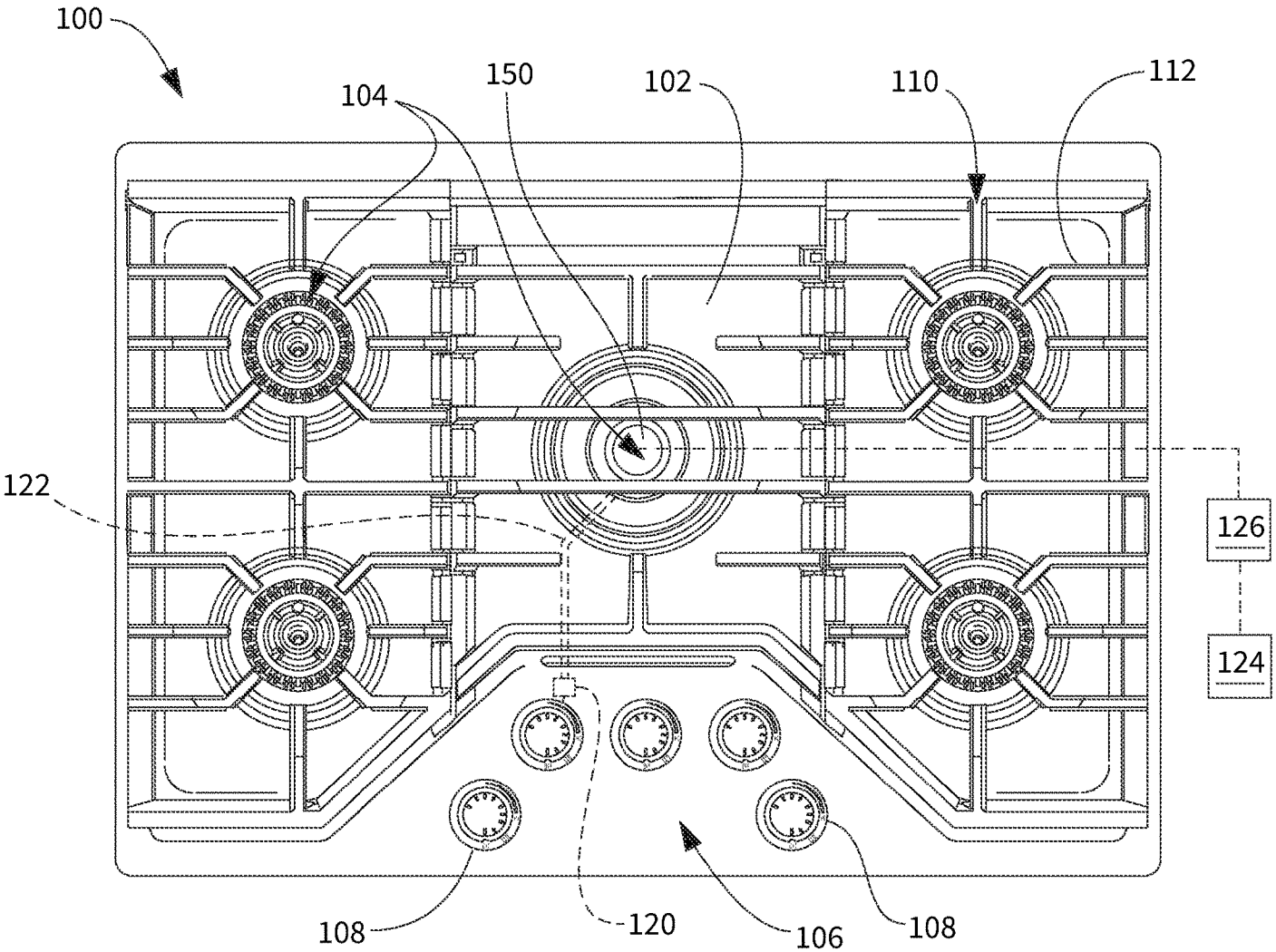
FIG. 1 provides a top view of a cooktop appliance according to one or more exemplary embodiments of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

According to the illustrated embodiment, cooktop appliance 100 is a gas cooktop and heating elements 104 are gas burners, such as gas burner assembly 150 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Figure 2:
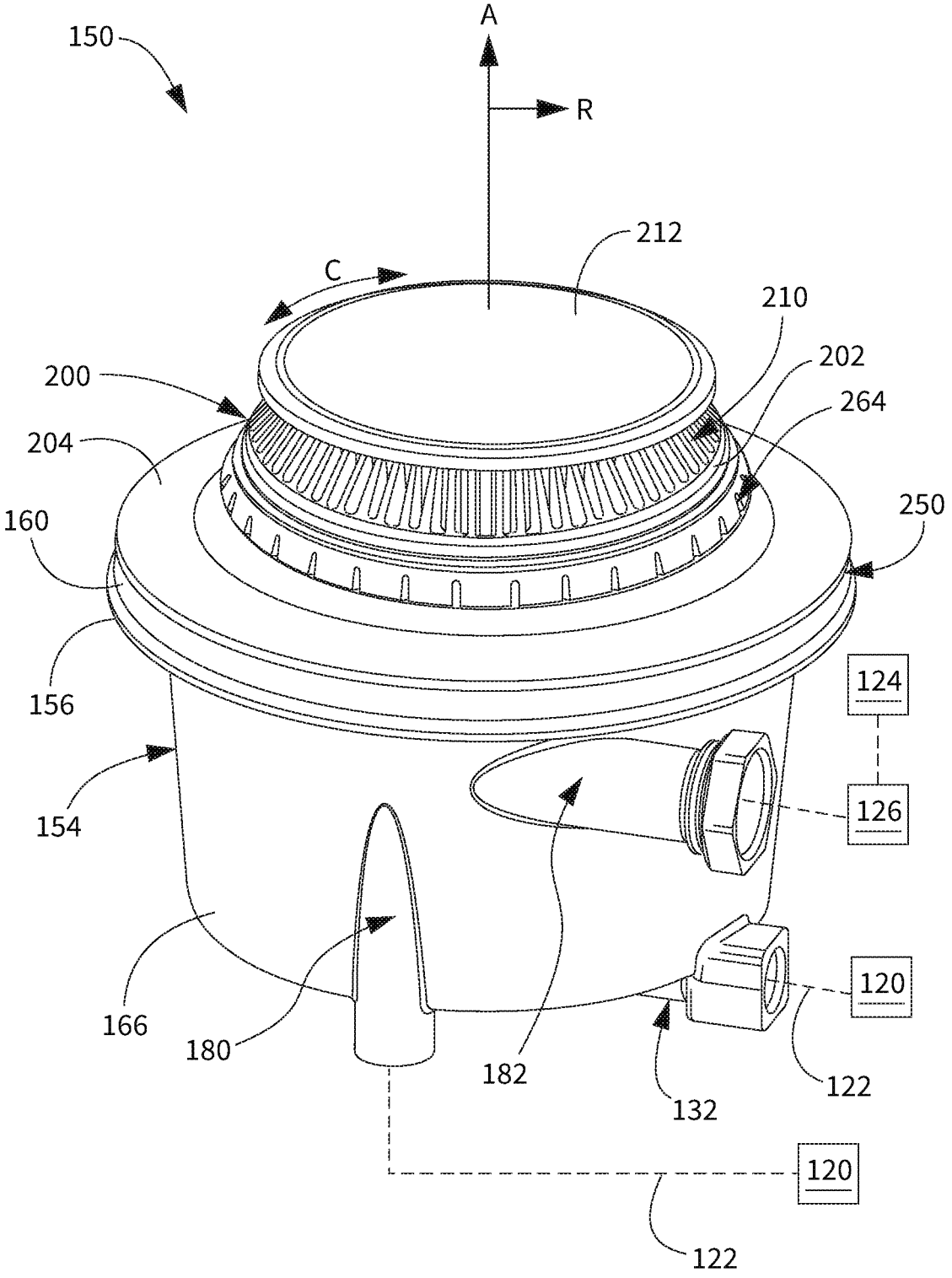
FIG. 2 provides a perspective view of a gas burner assembly of the exemplary cooktop appliance of FIG. 1 according to one or more exemplary embodiments of the present subject matter.
Figure 3:
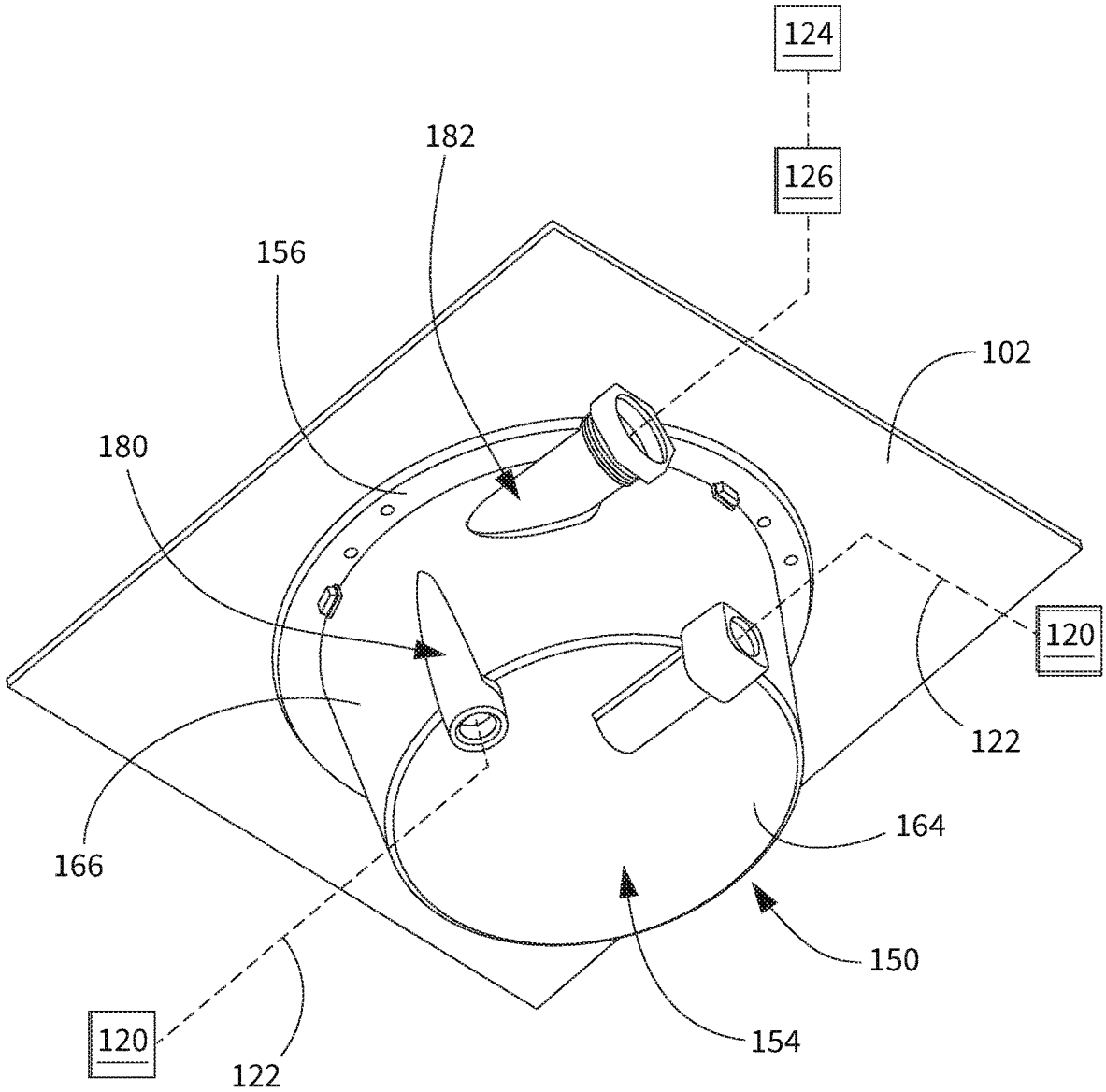
FIG. 3 provides a bottom perspective view of the exemplary gas burner assembly of FIG. 2 positioned within a top panel of the exemplary cooktop appliance of FIG. 1.

As shown schematically in FIGS. 1 through 3, cooktop appliance 100 includes a variety of control elements for regulating the amount of heat generated by heating elements 104. For example, as explained below, one or more of the heating elements 104 may be a gas burner assembly 150 that uses one or more flows of fuel and one or more flows of air for combustion. Thus, cooktop appliance 100 includes fuel control valves 120 and fuel lines 122 for supplying a metered amount of fuel to heating element 104. Fuel lines 122 extend between control valves 120 and one or more fuel orifices of heating element 104. Thus, when control valves 120 are open, fuel such as propane or natural gas may flow through fuel lines 122 to the fuel orifices for combustion. Similarly, cooktop appliance 100 includes a forced air supply 124 and an air regulator 126 for controlling the amount of forced air introduced to heating element 104 for combustion. For example, forced air supply 124 may be a fan, an air compressor, or any other suitable source of air.

Cooktop appliance 100 may further includes features for assisting mixing of air and fuel as the fuel enters heating element 104, e.g., injectors, Venturi mixers, etc. According to an exemplary embodiment, fuel control valves 120 are each coupled to a respective one of control knobs 108. Thus, a user may adjust fuel control valves 120 with control knobs 108, thereby regulating fuel flow to heating elements 104. Similarly, air regulator 126 may be either directly controlled by control knob 108 or may be controlled based on the amount of fuel supplied to obtain the desired air/fuel ratio for combustion. According to an exemplary embodiment, some or all of these control components may be mounted to panel top 102, e.g., on a bottom surface or underside of top panel 102.

Referring now generally to FIGS. 2 through 5, a gas burner assembly 150 that may be used with cooktop appliance 100 will be described in more detail. Although the discussion below refers to an exemplary gas burner assembly 150, it should be appreciated that the features and configurations described may be used for other heating elements in other cooking appliances or consumer appliances as well. For example, gas burner assembly 150 may be positioned elsewhere within cooktop appliance 100, may have different components or configurations, and use alternative mechanisms for mixing fuel and air for combustion. Other variations and modifications of the exemplary embodiment described below are possible, and such variations are contemplated as within the scope of the present subject matter.

Figure 4:
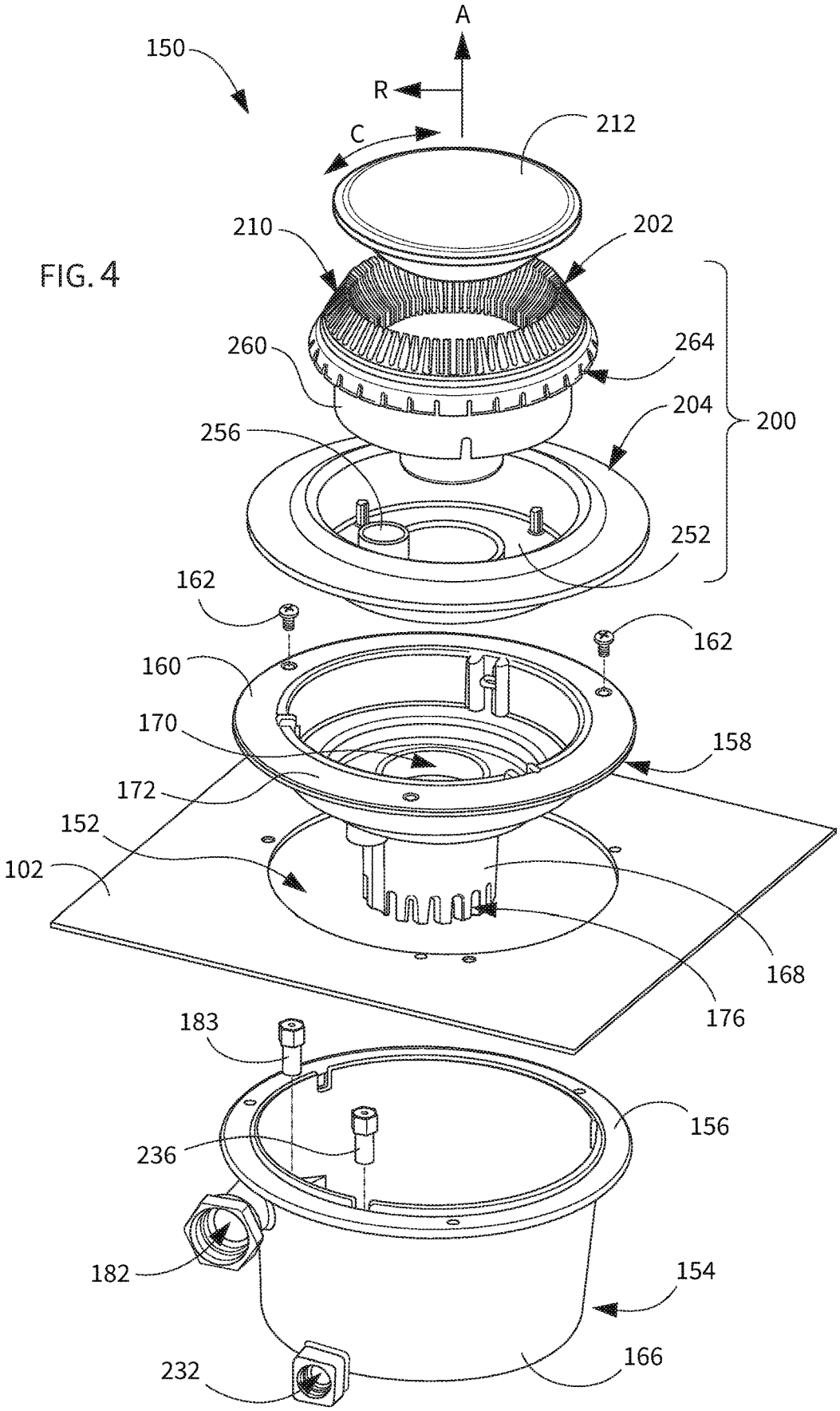
FIG. 4 provides an exploded perspective view of the exemplary gas burner assembly of FIG. 2.

Referring now to FIG. 4, an exploded view of gas burner assembly 150 will be described. As shown, gas burner assembly 150 generally defines an axial direction A, a radial direction R perpendicular to the axial direction A, and a circumferential direction C extending around the axial direction A. As illustrated, gas burner assembly 150 is mounted within an aperture 152 defined in top panel 102 of cooktop appliance 100. More specifically, gas burner assembly 150 includes a bottom housing 154 that defines a bottom flange 156 and is generally positioned below top panel 102 and a center body 158 that defines a top flange 160 and is generally positioned above top panel 102. According to the illustrated embodiment, gas burner assembly 150 is installed in aperture 152 by joining bottom housing 154 and center body 158 using any suitable mechanical fastener 162, such as screws, bolts, rivets, etc. Similarly, glue, bonding, snap-fit mechanisms, interference-fit mechanisms, or any suitable combination thereof be used to join bottom housing 154 and center body 158.

Figure 5:
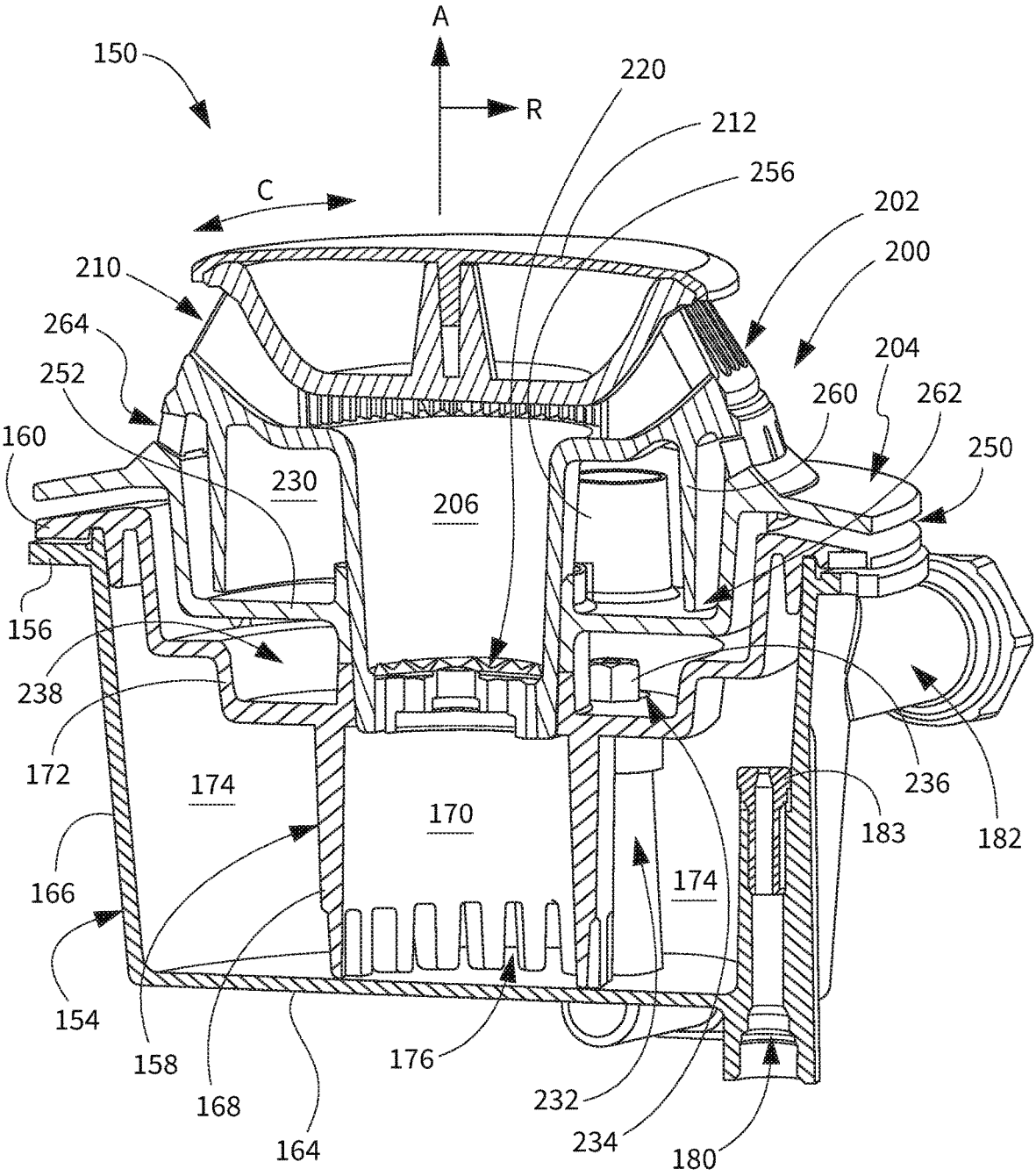
FIG. 5 provides a cross sectional view of the exemplary gas burner assembly of FIG. 2.

Referring now also to FIG. 5, bottom housing 154 includes a bottom wall 164 and a side wall 166 which generally cylindrically shaped and defines an open top. In addition, center body 158 generally includes a cylindrical lower wall 168 that defines an inner chamber 170 and an upper wall 172 that extends along the radial direction R out to top flange 160. Center body 158 is mounted within bottom housing 154 such that it is positioned concentrically within bottom housing 154 to define an annular mixing chamber 174, e.g., positioned between lower wall 168 and cylindrical wall 166. In this manner, inner chamber 170 is positioned inward of mixing chamber 174 along the radial direction R to define two separate chambers. In addition, according to an exemplary embodiment, lower wall 168 of center body 158 defines a plurality of apertures 176 providing fluid communication between mixing chamber 174 and inner chamber 170.

Mixing chamber 174 and inner chamber 170 are generally configured for receiving a flow of air and a flow of fuel and fully premixing them into a homogenous fuel mixture prior to combustion. In this manner, for example, bottom housing 154 defines a boost fuel inlet 180 and a boost air inlet 182 that are each in fluid communication with mixing chamber 174. For example, boost fuel inlet 180 may terminate in a spray nozzle 183 (see FIGS. 4 and 5) for directing the flow of fuel as desired. Boost fuel inlet 180 and boost air inlet 182 provide a flow of fuel and forced air, respectively, into mixing chamber 174. In order to increase residence time between the air and fuel to improve mixing, according to the illustrated embodiment, boost fuel inlet 180 and boost air inlet 182 are positioned proximate a top of mixing chamber 174, e.g., adjacent upper wall 172, and the plurality of apertures 176 are defined proximate a bottom of mixing chamber 174, e.g., as slots or openings defined by a distal end of lower wall 168. In this manner, fuel and air injected into mixing chamber 174 travels circumferentially within mixing chamber 174 around lower wall 168 as it migrates towards bottom wall 164 where it enters inner chamber 170 through apertures 176.

Referring again to FIGS. 4 and 5, cooktop appliance 100 further includes an upper housing assembly or upper housing 200 positioned over center body 158 along the axial direction A. Upper housing 200 may include one or more components for receiving and conditioning one or more flows of fuel and air and passing it to various flame ports defined by upper housing 200. As shown in the figures, upper housing 200 actually includes a top portion 202 and a bottom portion 204 that are joined together to define a primary burner and a boost burner. As may be seen, e.g., in FIG. 5, the bottom portion 204 may be positioned directly above the center body 158 and the top portion 202 of the upper housing 200 may be positioned above the bottom portion 204. The components of the upper housing 200 will be described in more detail below with respect to FIGS. 6 through 11.

Upper housing 200 generally defines a boost burner chamber 206 that extends along the axial direction A and is in fluid communication with inner chamber 170 of center body 158. Top portion 202 defines a plurality of boost flame ports 210 which extend outward along the radial direction R and upward along the axial direction A and are spaced about the circumferential direction C. Thus, the top portion 202 of the upper housing 200 may also be referred to as a flame ring in that the top portion 202 defines an annular array of flame ports, e.g., the boost flame ports 210. The plurality of boost flame ports 210 are in fluid communication with boost burner chamber 206. As will be described in more detail below, the plurality of boost flame ports 210 may, in some embodiments, be defined by and between an inner ring 201 and an outer ring 203. In addition, a top cap 212 is positioned on top of top portion 202 to provide a clean appearance to gas burner assembly 150 and to help disperse the fuel mixture around boost flame ports 210.

Gas burner assembly 150 further includes a flow developer 220 for straightening the flow of fuel mixture prior to passing through boost flame ports 210. For example, as illustrated, top portion 202 defines flow developer 220 which is positioned between inner chamber 170 and boost burner chamber 206 for straightening or conditioning a flow of mixed fuel and air. It should be appreciated that although flow developer 220 is illustrated as being positioned at a bottom of upper housing 200, flow developer 220 could be defined by center body 158 or could be a separate component according to alternative embodiments. In general, flow developer 220 includes a plurality of conduits or passageways 222 that extend generally along the axial direction A between inner chamber 170 and boost burner chamber 206. According to alternative embodiments, flow developer 220 may include a plurality of fins extending along the axial direction A or any other flow straightening structure.

In addition to including a boost burner as described above, gas burner assembly 150 further includes a primary burner. According to an exemplary embodiment, the primary burner is a normally aspirated burner that may be regulated for normal operation while boost burner is a discretely operating (i.e., on or off) auxiliary forced air burner intended for performing high heat operation such as boiling a large pot of water. However, it should be appreciated that the primary burner and boost burner may both be incrementally regulated simultaneously or independently of each other according to alternative embodiments.

As shown, upper housing 200 defines a primary burner chamber 230, or more specifically, primary burner chamber 230 is defined between top portion 202 and bottom portion 204. A primary fuel inlet 232 is in fluid communication with primary burner chamber 230 for providing a flow of fuel into primary burner chamber 230. More specifically, as illustrated in FIGS. 4 and 5, primary fuel inlet 232 passes from bottom wall 164 of bottom housing 154 along the axial direction A through mixing chamber 174. Primary fuel inlet 232 then passes through an aperture 234 (FIG. 5) defined in upper wall 172 of center body 158 and terminates in a spray nozzle 236 within an air entrainment chamber 238 defined between upper wall 172 and bottom portion 204 of upper housing 200.

Air entrainment chamber 238 is in fluid communication with a primary air inlet 250 that extends about the circumferential direction C above top panel 102 of cooktop appliance 100. More specifically, primary air inlet 250 is defined between upper wall 172 of center body 158 and bottom portion 204 of upper housing 200. In this manner, fresh primary supply air may be drawn from ambient through primary air inlet 250 into air entrainment chamber 238. In addition, as best shown in FIG. 5, air entrainment chamber 238 is separated from primary burner chamber 230 by a divider wall 252 that extends along the radial direction R and is part of bottom portion 204. Divider wall 252 defines a cylindrical channel 256 through which fuel discharged from spray nozzle 236 passes through air entrainment chamber 250 and into primary burner chamber 230. In this manner, ambient air from within air entrainment chamber 238 is entrained and mixed with the supply of fuel from primary fuel inlet 232 as it is injected into primary burner chamber 230.

In addition, the cylindrical channel 256 extends toward top portion 202 of upper housing 200. Notably, cylindrical channel 256 terminates proximate a top of primary burner chamber 230, e.g., adjacent top portion 202 of upper housing 200. In this manner, cylindrical channel 256 discharges a mixture of fuel and air proximate a top of primary burner chamber 230. In addition, top portion 202 of upper housing 200 defines a circumferential baffle 260 that is positioned within primary burner chamber 230 and extends down along the axial direction A toward bottom portion 204 to define an annular opening 262 proximate a bottom of primary burner chamber 230. In this manner, the fuel and air mixture that is ejected into primary burner chamber 230 migrates from a top of primary burner chamber 230 downward along the axial direction A toward annular opening 262, thereby increasing residence time and ensuring the mixture is more evenly dispersed throughout primary burner chamber 230 for improved combustion.

Figure 6:
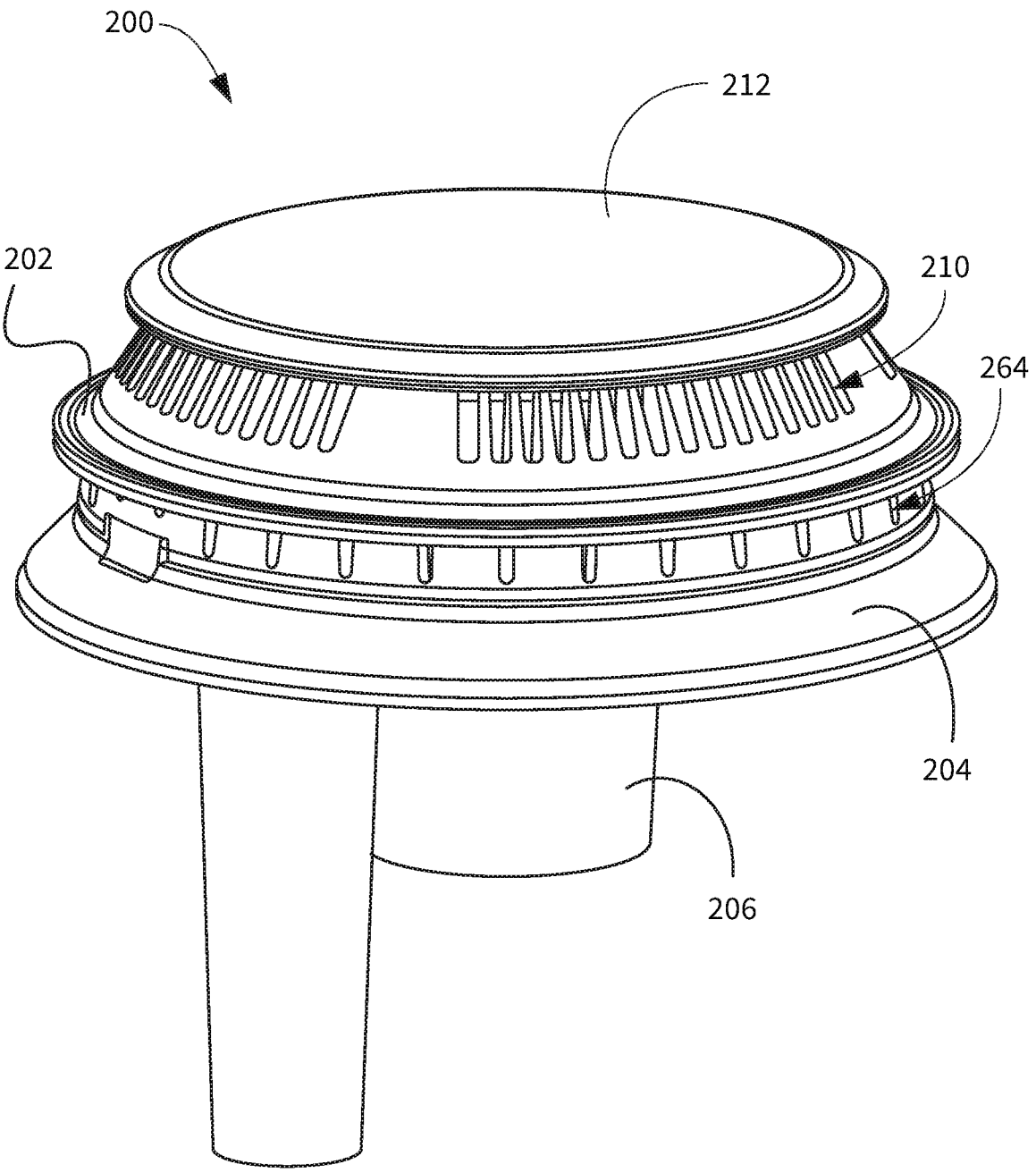
FIG. 6 provides a perspective view of an upper housing of the exemplary gas burner assembly of FIG. 2.

FIG. 6 provides a perspective view of the upper housing 200 isolated from the remainder of the gas burner assembly 150. As may be seen, for example, in FIG. 6, upper housing 200 also defines a plurality of primary flame ports 264 spaced about the circumferential direction C and in fluid communication with primary burner chamber 230 via annular opening 262. More specifically, primary flame ports 264 are defined between top portion 202 and bottom portion 204 of upper housing 200. In this manner, primary flame ports 264 are positioned below boost flame ports 210 along the axial direction A. The annular array of primary flame ports 264 may also be referred to as a flame ring, similar to the annular array of the boost flame ports 210 as described above. For example, embodiments where both the primary flame ports 264 and the boost flame ports 210 are provided, the primary flame ports 265 may comprise a first flame ring and the boost flame ports 210 may comprise a second flame ring.

Figure 7:
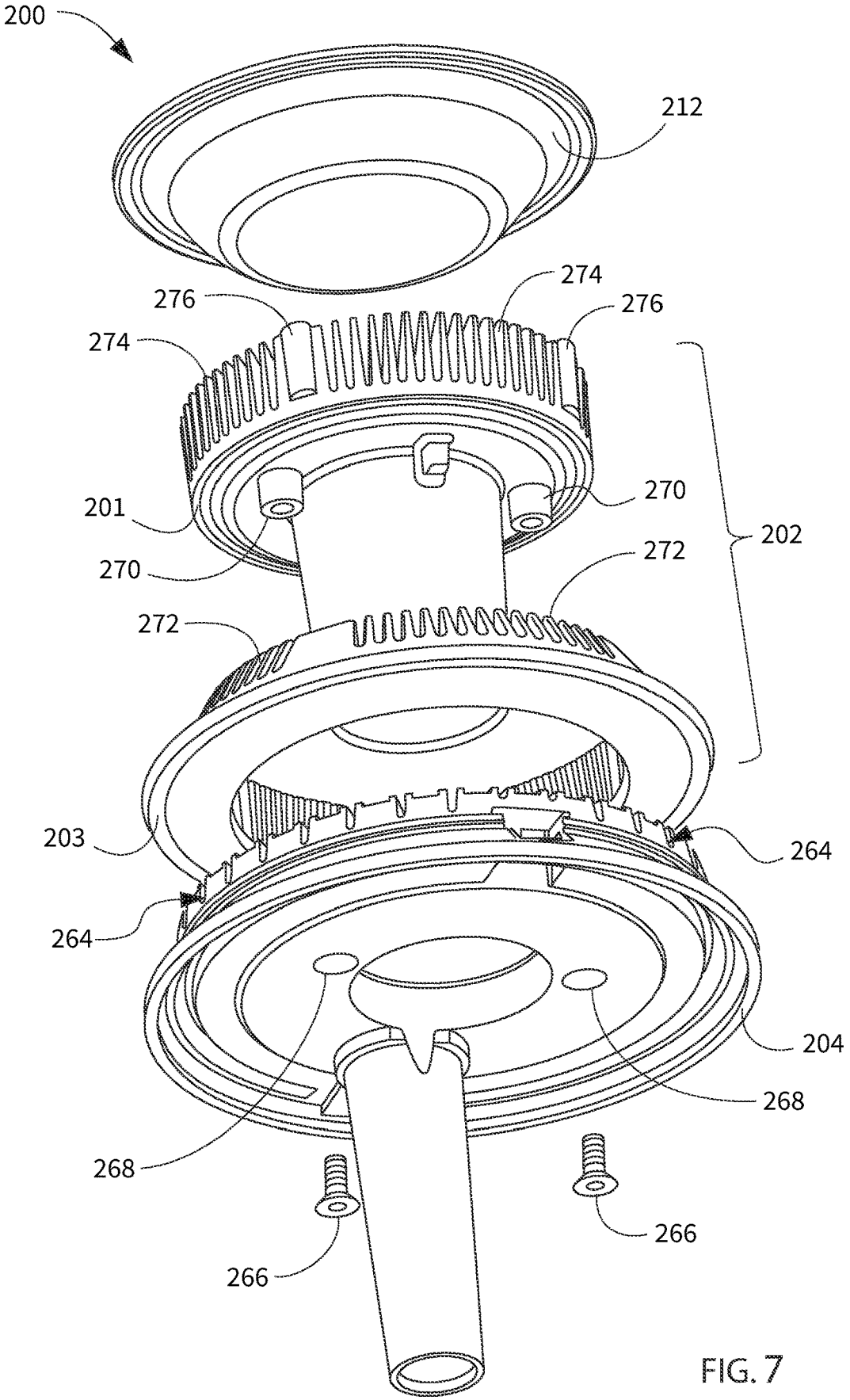
FIG. 7 provides an exploded bottom perspective view of the upper housing of FIG. 6.
Figure 8:
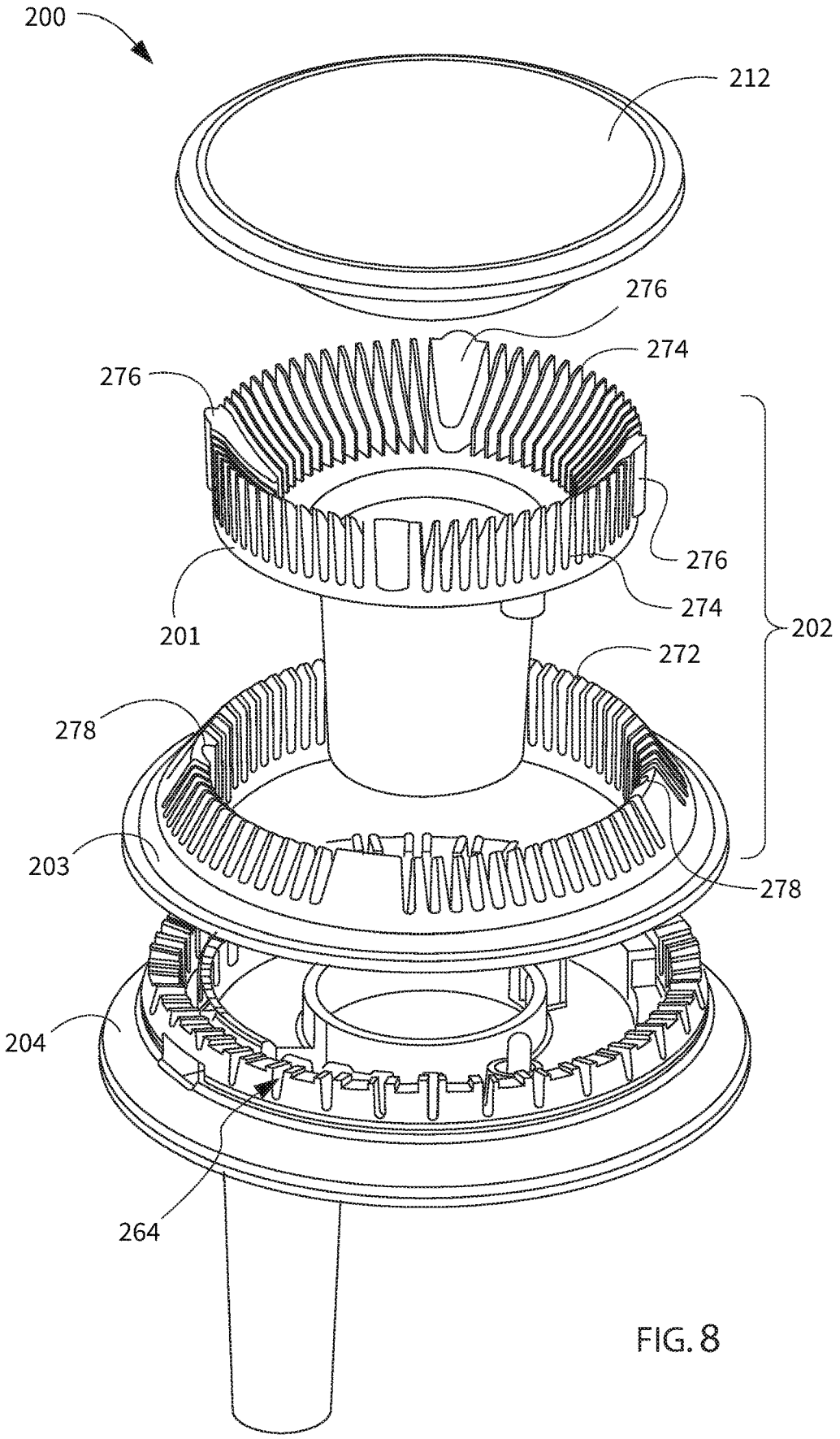
FIG. 8 provides an exploded top perspective view of the upper housing of FIG. 6.

FIGS. 7 and 8 provide exploded views of the upper housing 200 of FIG. 6. As may be seen in FIGS. 7 and 8, the bottom portion 204 and the top portion 202 may be joined together via fasteners 266, e.g., threaded fasteners such as bolts or screws, which extend through apertures 268 in the bottom portion 204 and into threaded bosses 270 in the top portion 202. Also as may be seen in FIGS. 7 and 8, the top portion 202 of the upper housing 200 may include an outer ring 203 concentrically aligned with an inner ring 201. As will be described in more detail below, the top portion 202 of the upper housing 200 defines the plurality of boost flame ports 210 collectively between the inner ring 201 and the outer ring 203, e.g., the plurality of boost flame ports 264 extend radially between the inner ring 201 and the outer ring 203.

Figure 9:
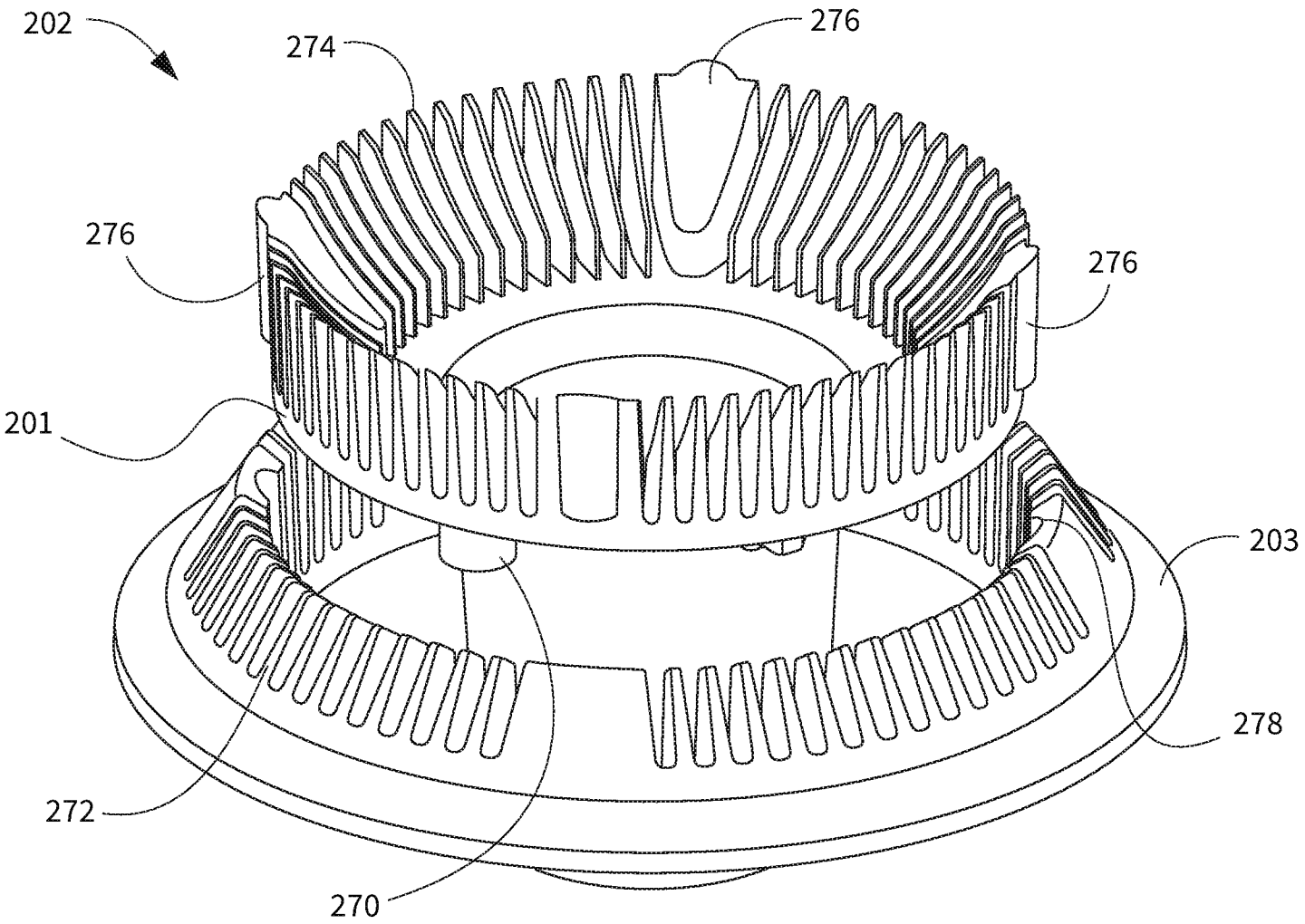
FIG. 9 provides an exploded perspective view of an inner ring and an outer ring of a top portion of the upper housing of FIG. 6.

FIG. 9 provides an exploded view of the top portion 202 of the upper housing 200. The cap 212 is omitted from FIGS. 9 through 11 for illustrative purposed to more clearly show internal details such as the plurality of boost flame ports 210. In particular, FIG. 9 illustrates the inner ring 201 and the outer ring 203 concentrically aligned and spaced apart along the axial direction A. The inner ring 201 and the outer ring 203 may be formed of different materials, e.g., the outer ring 203 may comprise a first material and the inner ring 201 may comprise a second material different from the first material. For example, the first material of the outer ring 203 may be or include brass and the second material may be or include aluminum. In some embodiments, the outer ring 203 may be a forged and machined part and the inner ring 201 may be a die cast part.

Figure 10:
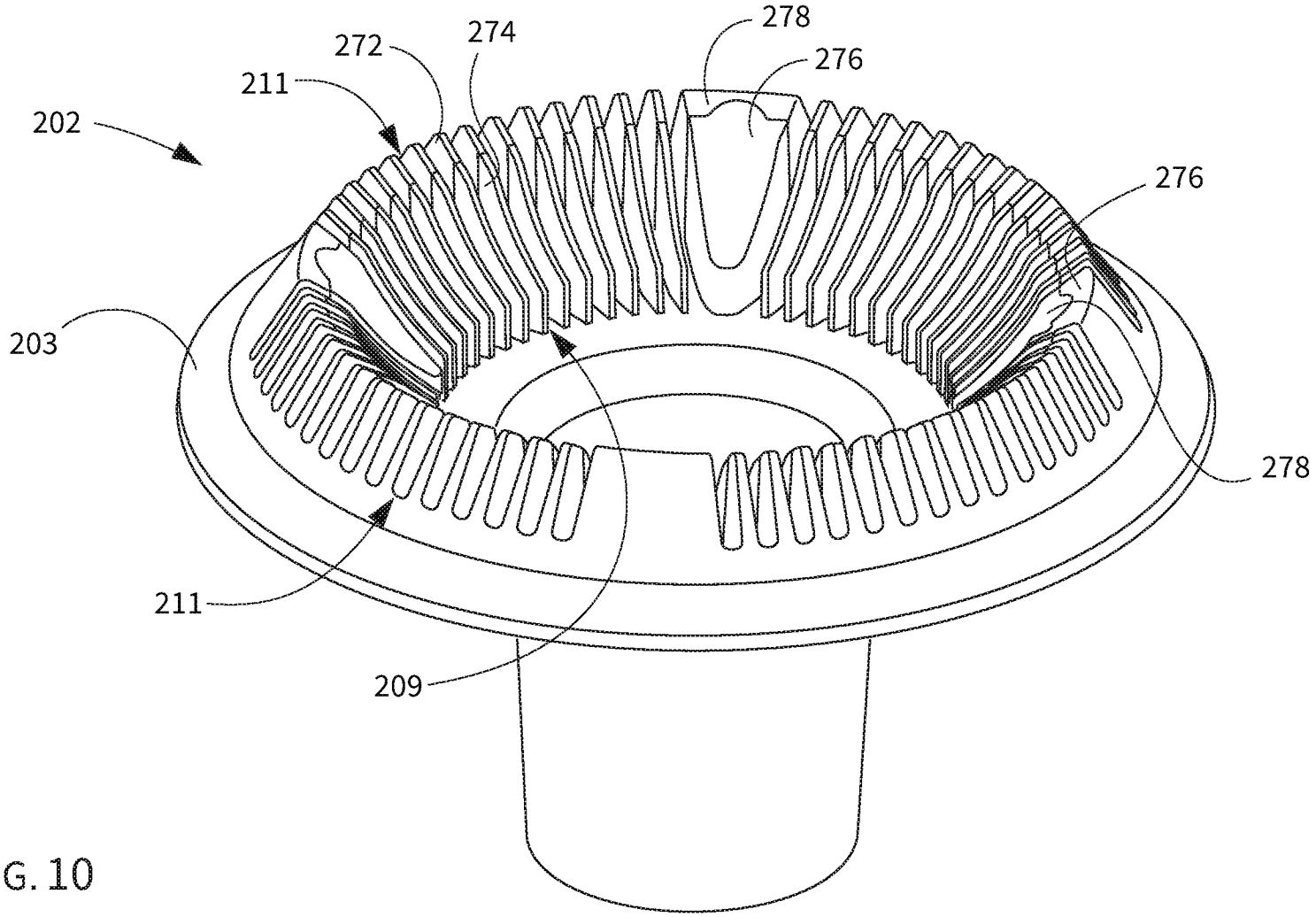
FIG. 10 provides a perspective view of the top portion of FIG. 9.
Figure 11:
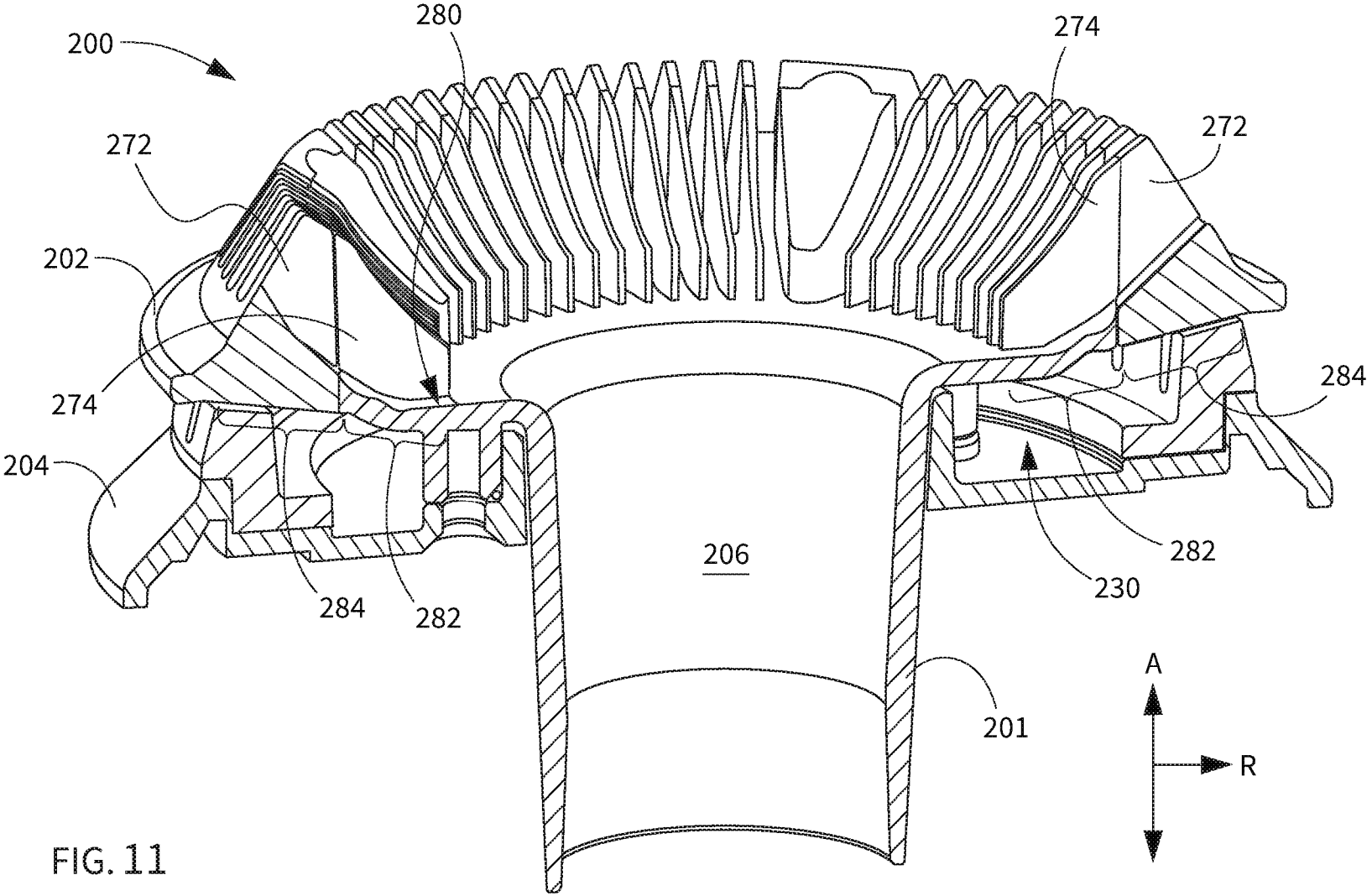
FIG. 11 provides a cross sectional view of the exemplary top portion of FIG. 10.

As may be seen, for example, in FIG. 9 the outer ring 203 may include a plurality of first fins 272 and the inner ring 201 may include a plurality of second fins 274. When the top portion 202 of the upper housing 200 is assembled, e.g., when the outer ring 203 is concentrically aligned and concentrically mated with the inner ring 201, as illustrated in FIGS. 10 and 11, each first fin 272 of the plurality of first fins 272 on the outer ring 203 is radially aligned and coplanar with a corresponding one second fin 274 of the plurality of second fins 274 on the inner ring 201. Thus, the plurality of first fins 272 on the outer ring 203 and the plurality of second fins 274 on the inner ring 201 collectively define the plurality of boost flame ports 210, e.g., each boost flame port 210 of the plurality of boost flame ports 210 is defined between a first aligned pair of fins 272, 274 and an adjacent pair of aligned fins 272, 274 along the circumferential direction C.

As may be seen in FIGS. 7 through 11, the inner ring 201 and the outer ring 203 may have interlocking or mating features to promote concentric alignment and mating therebetween. For example, one of the inner ring 201 and the outer ring 203 may include one or more projections 276 and the other of the inner ring 201 and the outer ring 203 may include a corresponding number of matingly shaped recesses 278. In the illustrated example embodiments, the projections 276 are semi-cylindrical projections formed on the inner ring 201 and the recesses 278 are mating semi-cylinders formed on the outer ring 203. As depicted, the inner ring 201 includes four projections 276 and the outer ring 203 includes four recesses 278. In other embodiments, any suitable shape or number of projections 276 and recesses 278 may be used. In some embodiments, combinations of differently shaped and/or sized projections 276 may be used, such that the inner ring 201 and the outer ring 203 fit together in only one orientation, e.g., to ensure that the apertures 268 and the bosses 270 are properly aligned and that the fins 272 and 274 are radially and circumferentially aligned and coplanar. For example, one projection 276 may be smaller or larger than the other projections 276, with only one recess 278 sized to snugly mate with the one projection 276, such that the inner ring 201 and the outer ring 203 fit together in only one orientation, when the one differently-sized projection 276 is aligned with the one differently-sized recess 278. As another example, one projection 276 may be polygonal, e.g., triangular, while the rest of the projections 276 are curved, and only one recess 278 matching the polygonal, e.g., triangular, projection 276 may be provided, such that the inner ring 201 and the outer ring 203 fit together in only one orientation, when the one polygonal projection 276 is aligned with the one polygonal recess 278.

As best seen in FIG. 10, each boost flame port 210 of the plurality of boost flame ports 210 extends from an inlet 209 defined by the inner ring 201 to an outlet 211 defined by the outer ring 203. FIG. 11 provides a cross-sectional illustration of the upper housing 200 sectioned along an axial-radial plane, that is, a plane defined by the axial direction A and the radial direction R. As may be seen in FIGS. 10 and 11, each boost flame port 210 of the plurality of boost flame ports 210 comprises an inner portion 282 (FIG. 11) defined by the inner ring 201 and an outer portion 284 (FIG. 11) defined by the outer ring 203. As best seen in FIG. 11, each boost flame port 210 includes a bottom channel 280 at an axially innermost and/or lowermost extent of the boost flame port 210. The bottom channel 280 of each boost flame port 210 of the plurality of boost flame ports 210 comprises a linear profile in the axial-radial plane across the outer portion 284 of each boost flame port 210 and a curvilinear profile in the axial-radial plane across the inner portion 282 of each boost flame port 210. In some exemplary embodiments, the curvilinear profile of the inner portion 282 of each boost flame port 210 of the plurality of boost flame ports 210 may have a compound curvature.

As mentioned above, the outer ring 203 may be forged and machined and the inner ring 201 may be die cast. For example, the outer ring 203 may be forged brass and may be machined to form the outer portions 284 of the boost flame ports 210 therein. For example, the outer ring 203 may be machined using a slit mill to form the outer portion 284 of each boost flame port 210 using only a linear slit tool path, which results in the bottom channel 280 of each boost flame port 210 having a linear profile in the axial-radial plane across the outer portion 284 of each boost flame port 210. As another example, the inner ring 201 may be die cast, such as die cast aluminum material, and the curvilinear profile of the inner portion 282 of each boost flame port 210 may be formed by die casting the aluminum material to form the inner ring 201.

One skilled in the art will appreciate that in addition to the configurations of gas burner assembly 150 described herein, alternative configurations of gas burner assembly 150 are possible and within the scope of the present subject matter. For example, the size, positioning, and configuration of bottom housing 154, center body 158, and upper housing 200 may vary, the various fuel and air mixing chambers may be positioned differently, and other mixing features or configurations may be used. It should be appreciated that still other configurations are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for a cooktop appliance, the gas burner assembly defining an axial direction, a radial direction perpendicular to the axial direction, and a circumferential direction extending around the axial direction, the gas burner assembly comprising:

an inner ring;

an outer ring adjoining the inner ring outward of the inner ring along the radial direction, wherein the outer ring and the inner ring are concentrically aligned and concentrically mated;

a plurality of flame ports arranged in an annular array and defining a flame ring of the gas burner assembly, each flame port of the plurality of flame ports collectively defined by and between the outer ring and the inner ring, each flame port of the plurality of flame ports extending continuously outward along the radial direction from an inlet defined by the inner ring to a joint between the inner ring and the outer ring and from the joint between the inner ring and the outer ring to an outlet defined by the outer ring, wherein the outer ring comprises a plurality of first fins and the inner ring comprises a plurality of second fins, each first fin of the plurality of first fins on the outer ring radially aligned and coplanar with a corresponding one second fin of the plurality of second fins on the inner ring, whereby each flame port of the plurality of flame ports is defined between adjacent pairs of aligned first fins and second fins;

a projection on one of the inner ring and the outer ring; and a recess on the other of the inner ring and the outer ring, wherein the projection and the recess are mated together to restrict relative rotation between the inner ring and the outer ring.

2. The gas burner assembly of claim 1, wherein each flame port of the plurality of flame ports comprises an inner portion defined by the inner ring and an outer portion defined by the outer ring, wherein a bottom channel of each flame port of the plurality of flame ports comprises a linear profile in an axial-radial plane across the outer portion of each flame port and a curvilinear profile in the axial-radial plane across the inner portion of each flame port.

3. The gas burner assembly of claim 2, wherein the curvilinear profile of the inner portion of each flame port of the plurality of flame ports comprises a compound curvature.

4. The gas burner assembly of claim 1, wherein the outer ring comprises a first material and the inner ring comprises a second material different from the first material.

5. The gas burner assembly of claim 4, wherein the first material comprises brass.

6. The gas burner assembly of claim 1, wherein the outer ring is a forged and machined part and the inner ring is a die cast part.

7. The gas burner assembly of claim 6, wherein each flame port of the plurality of flame ports comprises an inner portion defined by the inner ring and an outer portion defined by the outer ring, wherein the outer ring is machined using a slit mill to form the outer portion of each flame port using only a linear slit tool path, whereby a bottom channel of each flame port of the plurality of flame ports comprises a linear profile in an axial-radial plane across the outer portion of each flame port.

8. The gas burner assembly of claim 6, wherein each flame port of the plurality of flame ports comprises an inner portion defined by the inner ring and an outer portion defined by the outer ring, wherein the inner ring is die cast such that a bottom channel of each flame port of the plurality of flame ports comprises a curvilinear profile in an axial-radial plane across the inner portion of each flame port.

9. The gas burner assembly of claim 1, wherein the plurality of flame ports are a plurality of boost flame ports spaced about the circumferential direction and in fluid communication with a boost burner chamber, and wherein the gas burner assembly further comprises a plurality of primary flame ports spaced about the circumferential direction and in fluid communication with a primary burner chamber, the primary flame ports being positioned below the boost flame ports along the axial direction.

10. The gas burner assembly of claim 9, further comprising a primary air inlet extending about the circumferential direction above a top panel of the cooktop appliance, the primary air inlet being in fluid communication with an air entrainment chamber that is separated from the primary burner chamber by a divider wall, and wherein a primary fuel inlet sprays fuel through a hole defined in the divider wall such that ambient air is entrained with the fuel and drawn into the primary burner chamber.

11. The gas burner assembly of claim 10, wherein the air entrainment chamber is positioned below the primary burner chamber and the primary fuel inlet discharges a mixture of fuel and air proximate the top of the primary burner chamber.

12. A cooktop appliance, comprising:

a top panel; and a gas burner assembly positioned on the top panel, the gas burner assembly defining an axial direction, a radial direction perpendicular to the axial direction, and a circumferential direction extending around the axial direction, the gas burner assembly comprising:

an inner ring;

an outer ring adjoining the inner ring outward of the inner ring along the radial direction, wherein the outer ring and the inner ring are concentrically aligned and concentrically mated;

a plurality of flame ports arranged in an annular array and defining a flame ring of the gas burner assembly, each flame port of the plurality of flame ports collectively defined by and between the outer ring and the inner ring, each flame port of the plurality of flame ports extending continuously outward along the radial direction from an inlet defined by the inner ring to a joint between the inner ring and the outer ring and from the joint between the inner ring and the outer ring to an outlet defined by the outer ring, wherein the outer ring comprises a plurality of first fins and the inner ring comprises a plurality of second fins, each first fin of the plurality of first fins on the outer ring radially aligned and coplanar with a corresponding one second fin of the plurality of second fins on the inner ring, whereby each flame port of the plurality of flame ports is defined between adjacent pairs of aligned first fins and second fins;

a projection on one of the inner ring and the outer ring; and a recess on the other of the inner ring and the outer ring, wherein the projection and the recess are mated together to restrict relative rotation between the inner ring and the outer ring.

13. The cooktop appliance of claim 12, wherein each flame port of the plurality of flame ports comprises an inner portion defined by the inner ring and an outer portion defined by the outer ring, wherein a bottom channel of each flame port of the plurality of flame ports comprises a linear profile in an axial-radial plane across the outer portion of each flame port and a curvilinear profile in the axial-radial plane across the inner portion of each flame port.

14. The cooktop appliance of claim 13, wherein the curvilinear profile of the inner portion of each flame port of the plurality of flame ports comprises a compound curvature.

15. The cooktop appliance of claim 12, wherein the outer ring comprises a first material and the inner ring comprises a second material different from the first material.

16. The cooktop appliance of claim 12, wherein the outer ring is a forged and machined part and the inner ring is a die cast part.

17. The cooktop appliance of claim 16, wherein each flame port of the plurality of flame ports comprises an inner portion defined by the inner ring and an outer portion defined by the outer ring, wherein the outer ring is machined using a slit mill to form the outer portion of each flame port using only a linear slit tool path, whereby a bottom channel of each flame port of the plurality of flame ports comprises a linear profile in an axial-radial plane across the outer portion of each flame port.

18. The cooktop appliance of claim 16, wherein each flame port of the plurality of flame ports comprises an inner portion defined by the inner ring and an outer portion defined by the outer ring, wherein the inner ring is die cast such that a bottom channel of each flame port of the plurality of flame ports comprises a curvilinear profile in an axial-radial plane across the inner portion of each flame port.

* * * * *